US012351383B1

(12) United States Patent
Hamilton et al.

(10) Patent No.: US 12,351,383 B1
(45) Date of Patent: Jul. 8, 2025

(54) BEVERAGE CAN CONTAINER

(71) Applicants: Casey Hamilton, Centerville, TX (US); Starla Hamilton, Centerville, TX (US)

(72) Inventors: Casey Hamilton, Centerville, TX (US); Starla Hamilton, Centerville, TX (US)

( * ) Notice: Subject to any disclaimer, the term of this patent is extended or adjusted under 35 U.S.C. 154(b) by 0 days.

(21) Appl. No.: 18/584,518

(22) Filed: Feb. 22, 2024

(51) Int. Cl.
*B65D 81/38* (2006.01)
*B65D 43/16* (2006.01)

(52) U.S. Cl.
CPC ..... *B65D 81/3876* (2013.01); *B65D 43/163* (2013.01)

(58) Field of Classification Search
CPC ..... B65D 81/3865; B65D 81/3867; B65D 81/3869; B65D 81/3874; B65D 81/3876; B65D 81/3879; B65D 81/3881; B65D 81/3883; B65D 81/3888; B65D 81/389; B65D 81/3893; B65D 81/3897; B65D 43/163; B65D 43/26
See application file for complete search history.

(56) References Cited

U.S. PATENT DOCUMENTS

| | | | | |
|---|---|---|---|---|
| 4,735,333 | A | 4/1988 | Lay | |
| 4,872,577 | A | 10/1989 | Smith | |
| 5,377,882 | A * | 1/1995 | Pham | B65D 47/04 222/491 |
| 6,039,207 | A | 3/2000 | Adamek | |
| 9,339,134 | B1 | 5/2016 | Poole | |
| D776,487 | S | 1/2017 | Peeters | |
| 11,503,934 | B1 * | 11/2022 | Wegner | B65D 81/3876 |
| 2006/0249534 | A1 * | 11/2006 | Sainz | B65D 83/04 206/277 |
| 2012/0318804 | A1 * | 12/2012 | Wamack, Jr. | B65D 81/3876 220/592.16 |
| 2015/0191293 | A1 * | 7/2015 | Forcella | A47G 23/0233 220/592.16 |
| 2023/0002141 | A1 * | 1/2023 | Ward | B29C 45/0053 |

FOREIGN PATENT DOCUMENTS

| | | |
|---|---|---|
| CA | 2005575 | 6/1990 |

* cited by examiner

*Primary Examiner* — Javier A Pagan

(57) ABSTRACT

A beverage can container to seal and insulate a beverage can therein. The beverage can container includes a container body and a container lid that is pivotably connected to the container body by a hinge. The container lid is designed to close and seal the opening in the container body in an essentially airtight manner. The beverage can container further includes a projection that defines an air chamber in the container body. The projection can be manually depressed to displace the air therein and push the container lid open and out of sealing engagement with the container body.

20 Claims, 6 Drawing Sheets

BEVERAGE CAN CONTAINER

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to beverage can containers for sealing and insulating beverage cans therein and more particularly pertains to a new beverage can container for sealing and insulating a beverage can therein that is simplified and openable by air pressure.

(2) Description of Related Art Including Information Disclosed Under 37 CFR 1.97 and 1.98

The prior art relates to beverage can containers for sealing and insulating beverage cans therein. These beverage can containers can have tops or lids that are connected to the container body and openable and closable. However, these designs are relatively complex and require the user to disconnect a closing device or pull on the container lid to open the container, which could result in spillage of the contents of the beverage can. None of the prior art discloses the use of air pressure to easily open the container lid without the need for the user to manually lift or pull the lid open.

BRIEF SUMMARY OF THE INVENTION

An embodiment of the disclosure meets the needs presented above by generally comprising a beverage can container configured to seal and insulate a beverage can therein. The beverage can container comprises a container body comprising an opening therein to permit insertion of a beverage can into the container body. The container body is substantially cylindrical and includes a side wall and a bottom wall designed to essentially follow the shape of a beverage can. The beverage can container further comprises a container lid that is pivotably connected to the container body by a hinge. The container lid is designed to close and seal the opening in the container body in an essentially airtight manner. The beverage can container further comprises a projection that is designed to project outwardly and away from the outer surface of the container body. The projection defines an air chamber in the container body. The projection is flexible and designed to be manually depressed by a user to displace the air therein and thereby push the container lid open and out of sealing engagement with the container body.

A user can use the beverage can container by first inserting a beverage can through the opening and into the container body. Once the beverage can is inserted, the user can pivot the container lid and close and seal the opening in an essentially airtight manner. When the user wishes to open the beverage can container, the user manually depresses the projection and displaces the air in the chamber. The displaced air exerts a force on the container lid and pushes the container lid open and out of sealing engagement with the container body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
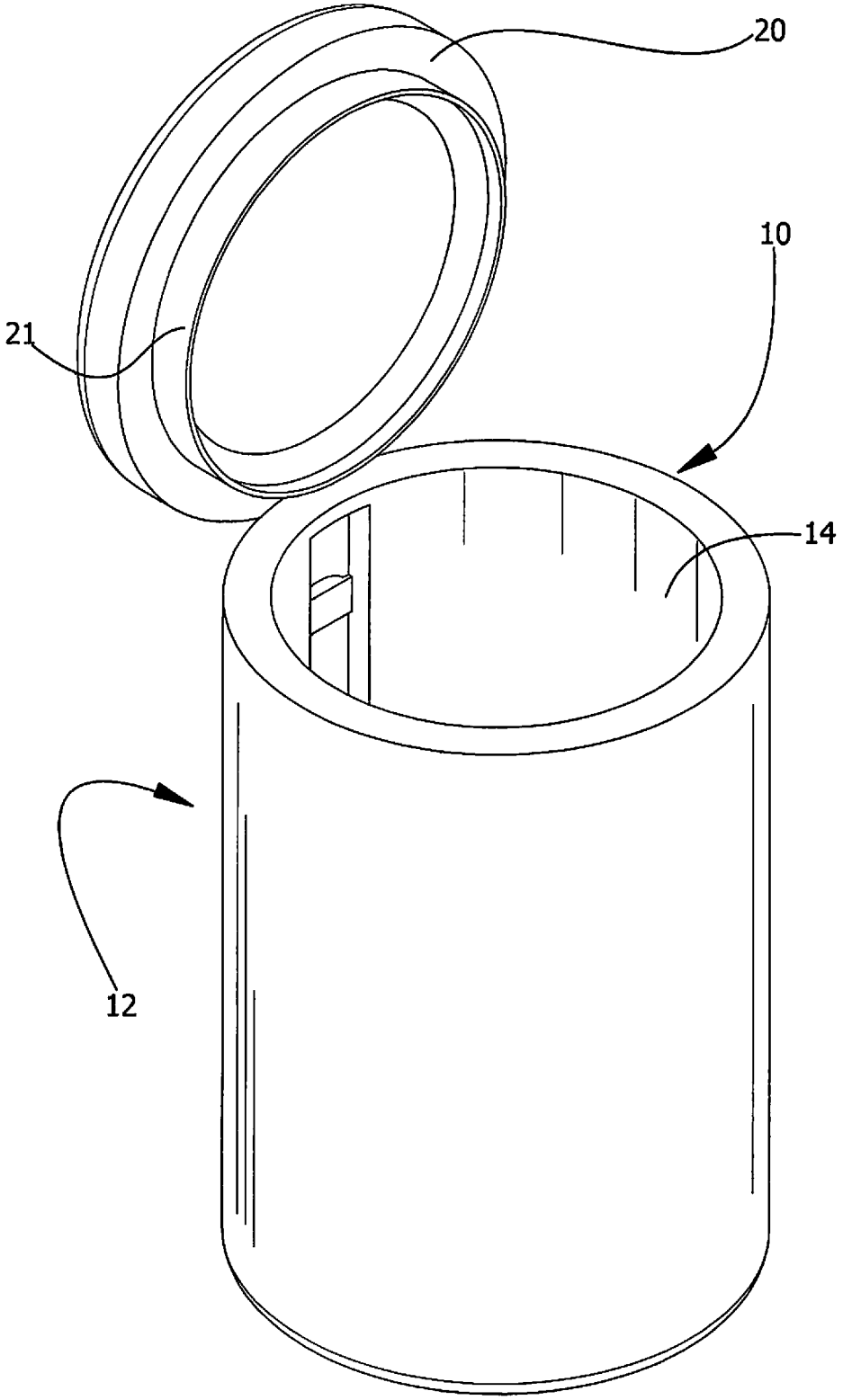
FIG. 1 is a top perspective view of a beverage can container according to an embodiment of the disclosure.

With reference now to the drawings, and in particular to FIGS. 1 through 6 thereof, a new beverage can container for sealing and insulating a beverage can therein embodying the principles and concepts of an embodiment of the disclosure and generally designated by the reference numeral 10 will be described.

Figure 2:
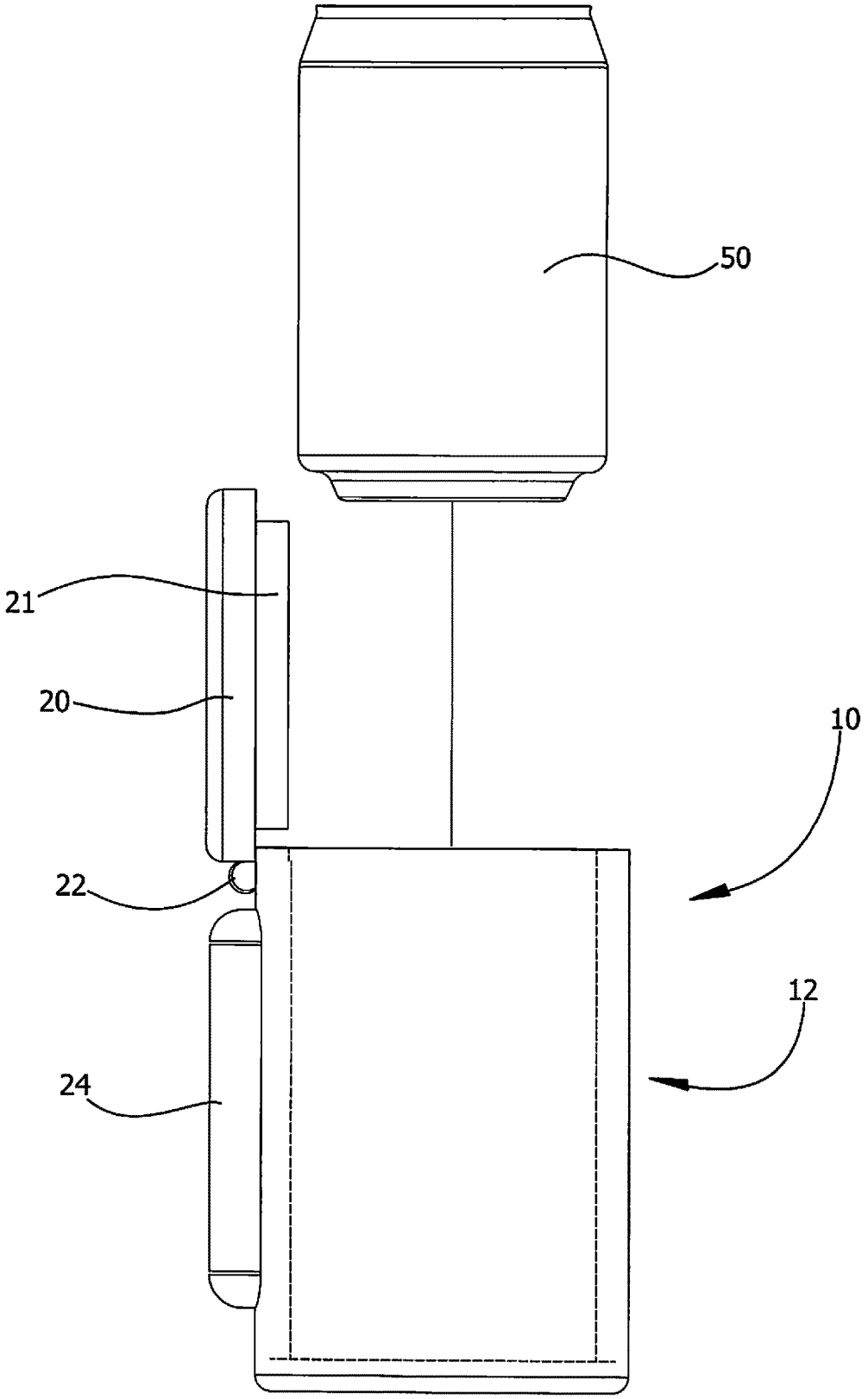
FIG. 2 is a side view of the beverage can container in an open position.
Figure 3:
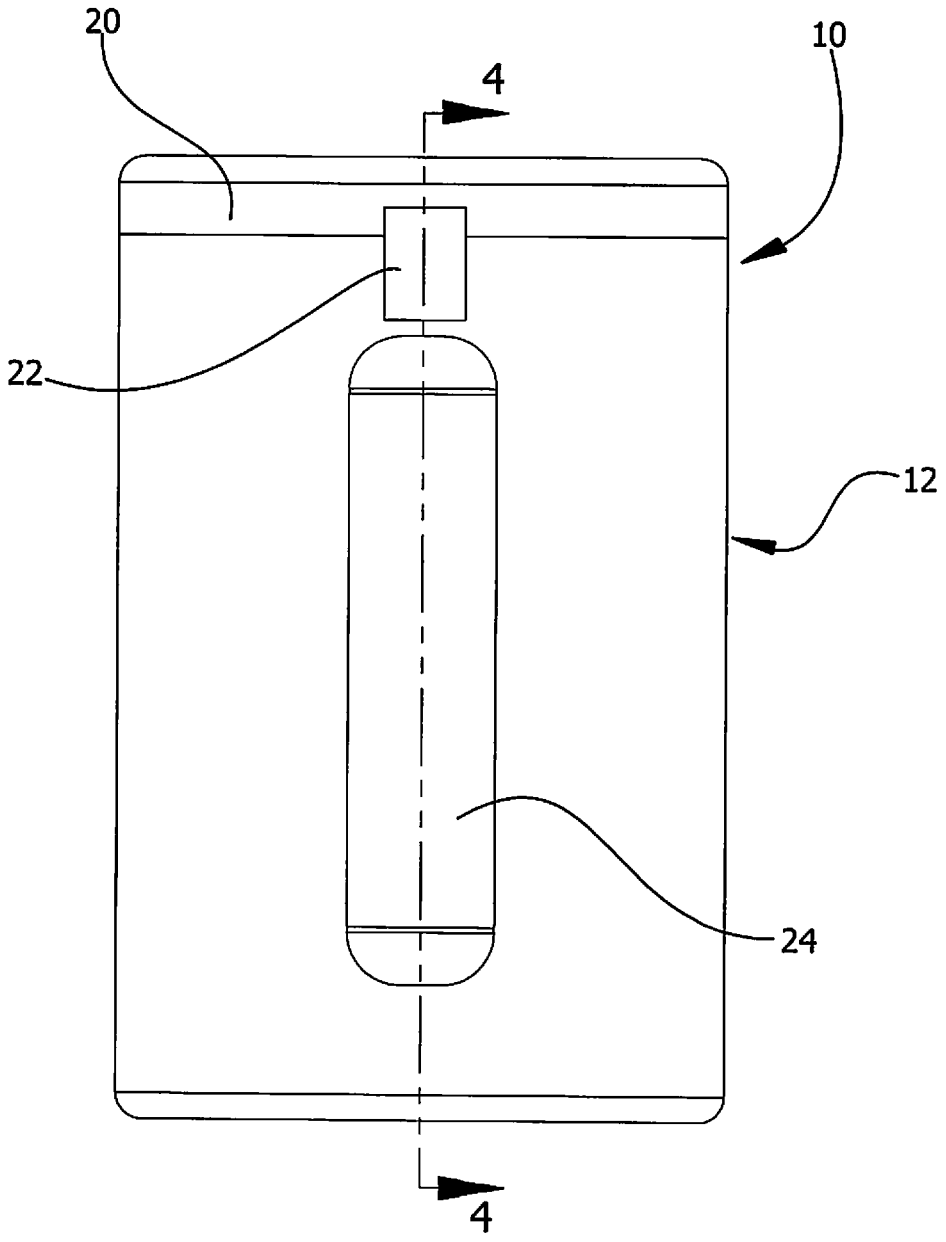
FIG. 3 is a rear view of the beverage can container in a closed position.

As seen in FIGS. 1 and 2, the beverage can container 10 is designed to seal and insulate a beverage can 50 therein. The beverage can container 10 includes a container body 12 comprising an opening or mouth portion 14 therein to permit insertion of the beverage can 50 into the container body 12. The container body 12 is substantially cylindrical and includes a side wall 16 and a bottom wall 18 designed to essentially follow the shape of a beverage can 50. The beverage can container 10 further comprises a container lid 20 that is pivotably connected to the container body 12 by a hinge 22. The container lid 20 is designed to close and seal the opening 14 in the container body 12 in an essentially airtight manner. The beverage can container 10 further comprises a projection 24 that is designed to project outwardly and away from the outer surface of the container body 12. The projection 24 defines an air chamber 26 in the container body 12. The projection 24 is flexible and designed to be manually depressed by a user to displace the air therein and thereby push the container lid 20 open and out of sealing engagement with the container body 12.

Figure 4:
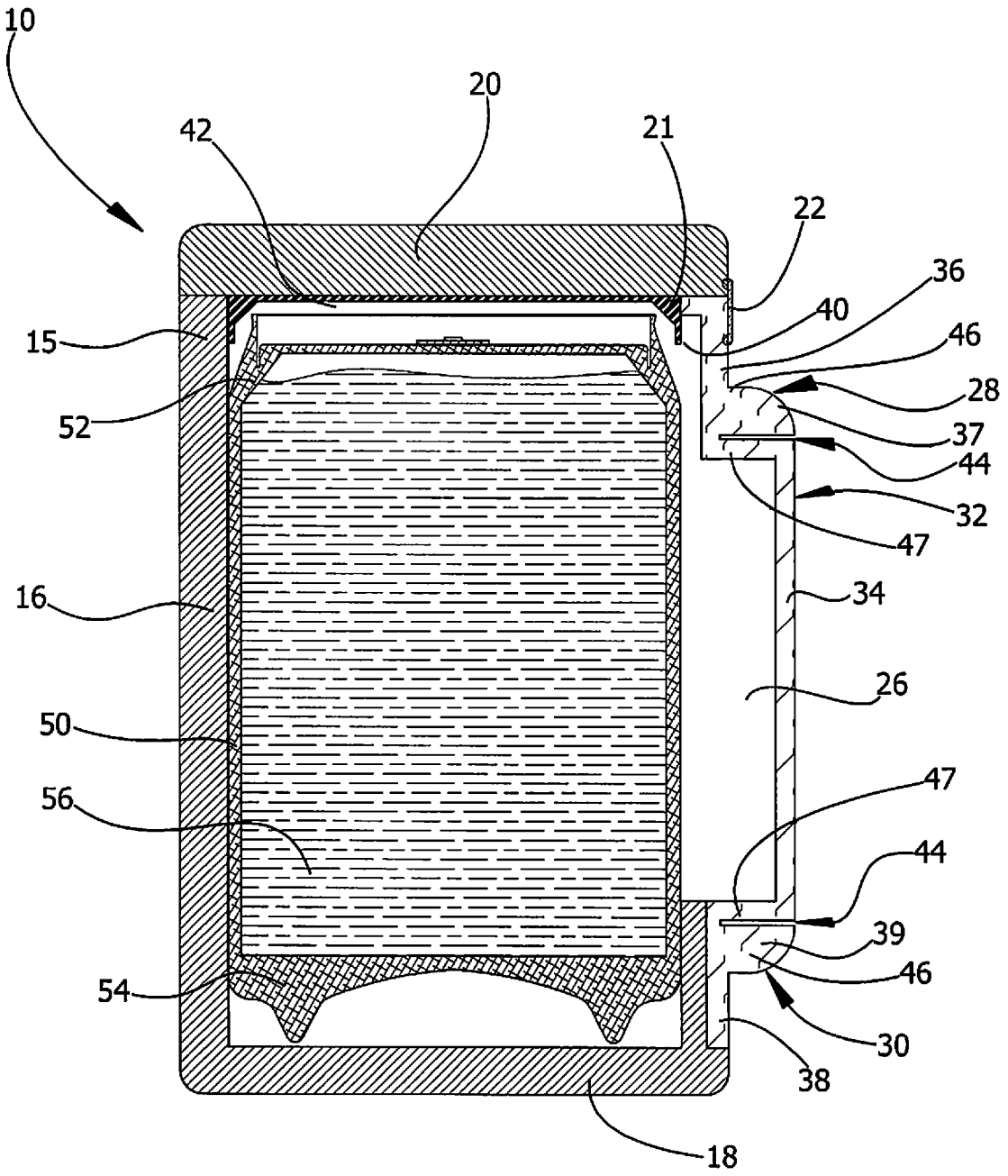
FIG. 4 is a cross-sectional view of the beverage can container in a closed position.
Figure 5:
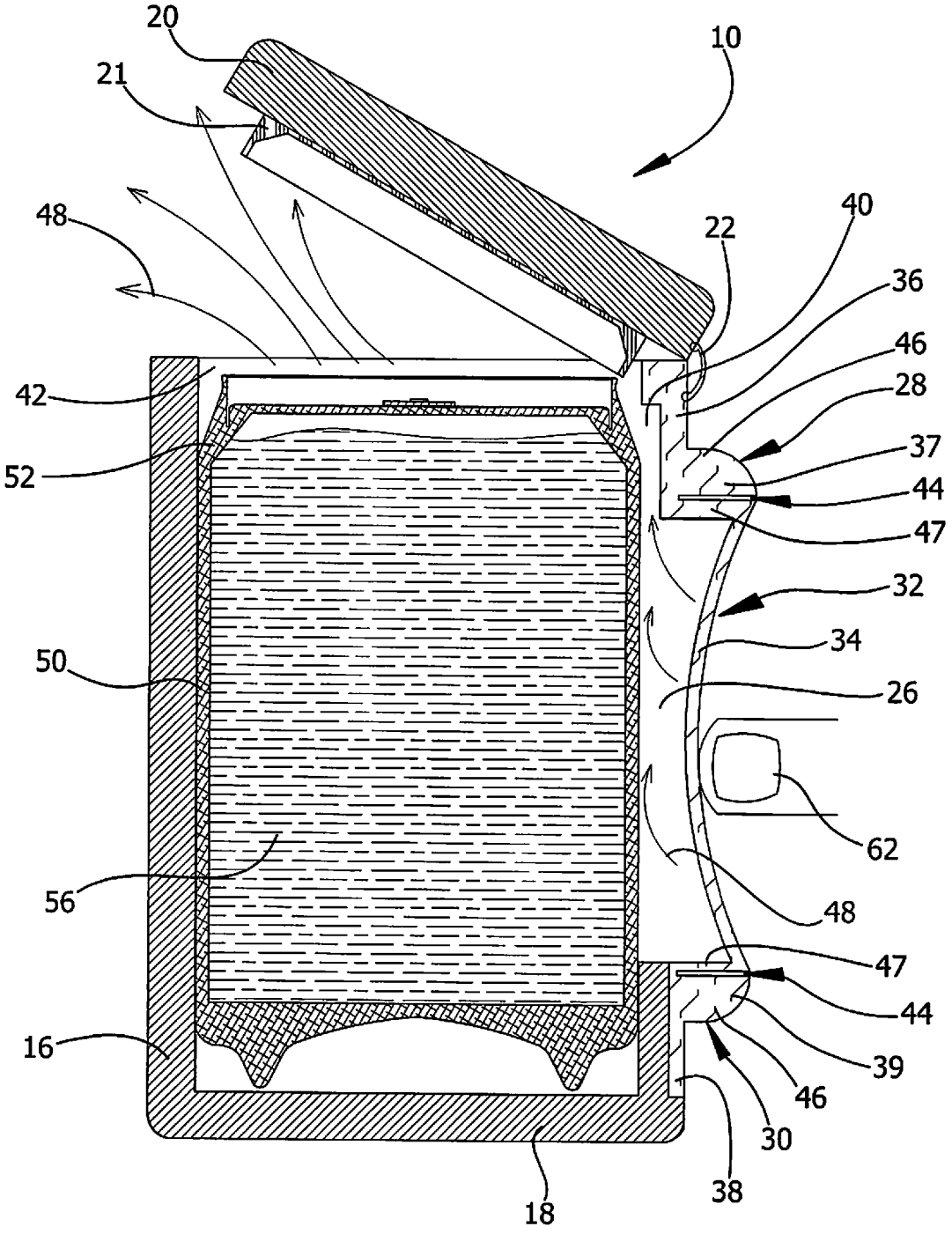
FIG. 5 is a cross-sectional view of the beverage can container in an open position.
Figure 6:
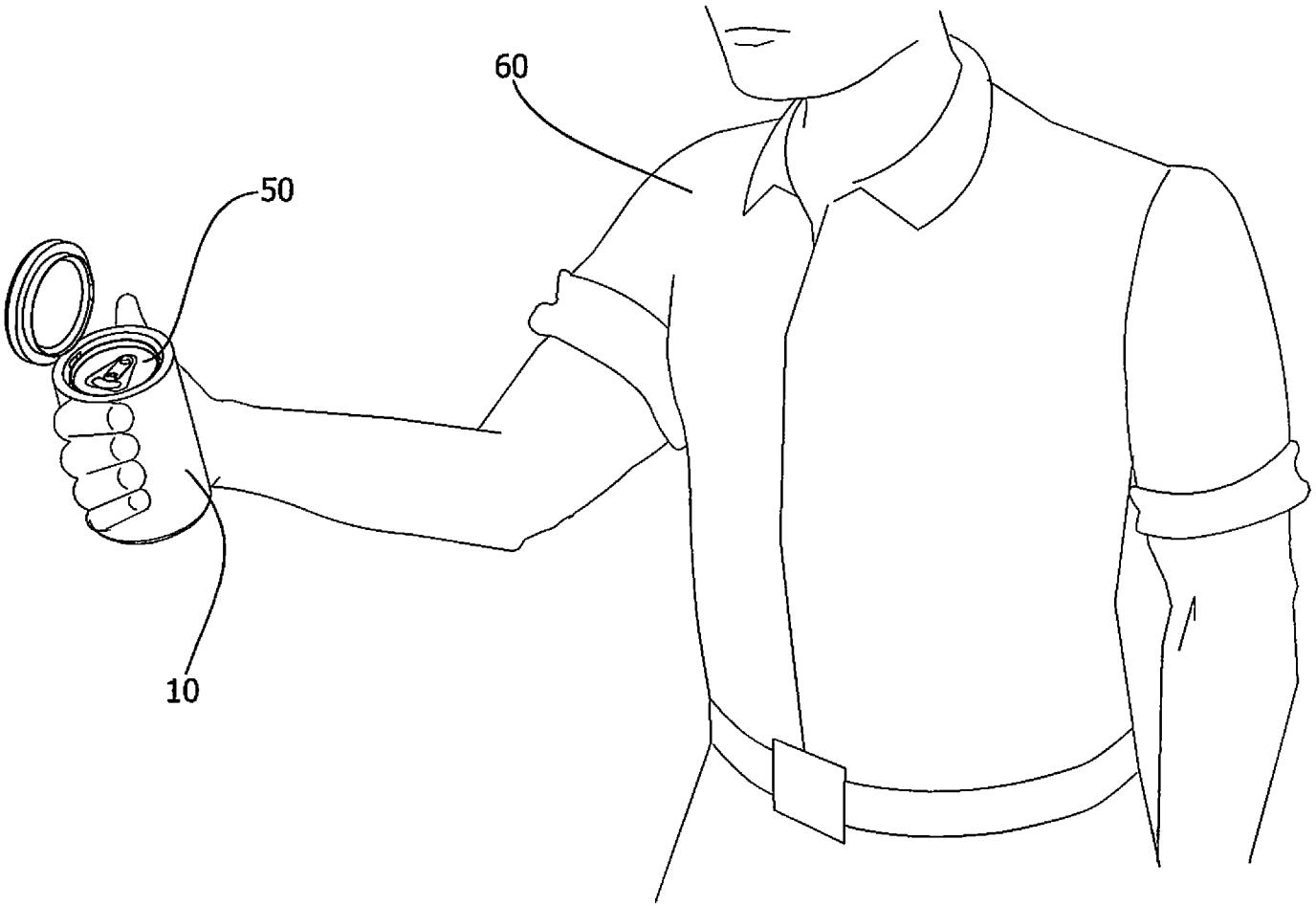
FIG. 6 is a view of a user holding the beverage can container in an open position.

The projection 24 includes a first end portion 28 disposed adjacent the opening 14 and a second end portion 30 disposed adjacent the bottom wall 18. There is also an elongated main portion 32 disposed between the first and second end portions 28, 30 and to extend along a substantial portion of the length of the container body 12. As seen in FIGS. 4 and 5, the elongated main portion 32 includes a thin wall 34 having a thickness that is less than a thickness of the side wall 16 to promote temporary deformation of the elongated main portion 32. The elongated main portion 32 can be made of a resiliently elastic material, such as rubber, plastic, or similar elastomeric material, so it can be pressed in by the thumb of user and then released to return to its original shape. The first end portion 28 includes a first wall portion 36 that forms a portion of the side wall 16 of the container body 12. The second end portion 30 includes a second wall portion 38 that also forms a portion of the side wall 16 of the container body 12. The first wall portion 36 has a thickness that is less than the thickness of the side wall 16 of the container body 12 to form an air passage 40 between the first wall portion 36 and the beverage can 50 inserted in the container body 12. The air passage 40 connects the air chamber 26 to an air space 42 under the container lid 20 adjacent a lip portion or mouth portion 52 of a beverage can 50 inserted in the container body 12.

The first end portion 28 of the projection 24 includes a first projecting portion 37 that projects out and away from the first wall portion 36 and has a greater thickness than the first wall portion 36. Similarly, the second end portion 30 includes a second projecting portion 39 that projects out and away from the first wall portion 36 and has a greater thickness than the first wall portion 36. The first and second projecting portions 37, 39 form end walls of the air chamber 26 and the elongated main portion 32 forms a side wall of the air chamber 26.

As shown in FIGS. 4 and 5, in accordance with at least one possible embodiment, each of the two projecting portions 37, 39 includes a notch or recess 44 that divides its projecting portion 37, 39 into a reinforcing portion 46 and a flexible portion 47. The flexible portion 47 is integrally formed with the elongated main portion 32. In the embodiment shown, the flexible portion 47 is of similar thickness as the elongated main portion 32 to facilitate temporary deformation and displacement of the elongated main portion 32. In other words, the lesser thickness makes it easier for a user to push on the projection 24 like a button by depressing and flexing the elongated main portion 32, and thereby compressing the air chamber 26 to force air out. In contrast, the reinforcing portion 46 has a substantially greater thickness than the flexible portion 47 to protect against damage or excessive deformation of the flexible portion 47.

In accordance with at least one possible embodiment, the projection 24 could be integrally formed with the container body 12, that is, made of the same material and in one piece. In accordance with another possible embodiment, the projection 24 could be attached to the container body 12 and/or made of a different material than the container body 12. For example, the container body 12 and/or lid 20 could be made of a harder or stiffer material, such as a harder plastic or rubber or metal, while the projection 24 could be made of a more flexible material, such as a flexible or softer rubber or plastic. In the embodiment shown in FIGS. 4 and 5, the projection 24 is connected to the container body 12. The second wall portion 38 is connected to the outside of the side wall 16, such that the side wall 16 is between the second wall portion 38 and the beverage can 50. The side wall 16 at this section is in sealing or gripping contact with a bottom portion 54 of the beverage can 50 around the circumference of the beverage can 50, which seals off any space below the beverage can 50 to prevent air in the air chamber 26 from passing into this space. In contrast, the first wall portion 36 and the elongated main portion 32 together essentially take the place of the side wall 16 where the projection 24 is located. As a result, the side wall 16 of the container body 12 does not extend in sealing contact around the entire circumference of the beverage can 50. This permits the formation of the air passage 40 and air chamber 26 between the projection 24 and the beverage can 50.

The container lid 20 includes a sealing structure 21 designed to project from an interior surface of the container lid 20. When the container lid 20 is closed, the sealing structure 21 projects into and sealingly engages, in an airtight manner, with a mouth portion 15 of the container body 12 about the opening 14. The sealing structure 21 can include or be in the form of a rubber gasket that is substantially cylindrical and has an outer surface designed to essentially match the interior shape of the container body 12 at the container opening 14. As shown in FIG. 4, the sealing structure 21 is shaped to essentially match or follow the lip portion 52 of the beverage can 50 to minimize the air space under the container lid 20. The smaller air space allows for the container lid 20 to be displaced with a lesser pressing force on the elongated main portion 32 of the projection 24. The design also could help minimize leaking or spilling of beverage out of the beverage can 50 and/or into the interior of the container body 12.

A user 60 can use the beverage can container 10 by first inserting a beverage can 50 through the opening 14 and into the container body 12. Once the beverage can 50 is inserted, the user 60 can pivot the container lid 20 and close and seal the opening 14 in an essentially airtight manner. When the user 60 wishes to open the beverage can container 10, the user 60 can manually depress the projection 24 with a finger or thumb 62 and displace the air in the air chamber 26, which flow of air is represented by arrows 48. The air travels through the air passage 40 to the air space. The displaced air increases the pressure inside the container body 12 and thereby exerts a force on the container lid 20, which force is sufficient to push the container lid 20 open and out of sealing engagement with the container body 12. The user 60 can then consume the beverage 56 in the beverage can 50.

In accordance with at least one possible embodiment, the beverage can container 10 comprises insulating material to help maintain the temperature of the beverage therein.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A beverage can container configured to seal and insulate a beverage can therein, said beverage can container comprising:

a container body comprising an opening configured to permit insertion of a beverage can therein;

said container body being substantially cylindrical and comprising a side wall and a bottom wall configured to essentially follow the shape of a beverage can;

a container lid being pivotably connected to said container body by a hinge;

said container lid being configured to close and seal said opening in said container body in an essentially airtight manner;

a projection configured and disposed to project outwardly and away from the outer surface of said container body;

said projection being configured to define an air chamber therein; and said projection being flexible and configured to be manually depressed by a user to displace the air therein and thereby push said container lid open and out of sealing engagement with said container body.

2. The beverage can container according to claim 1, wherein said projection comprises:

a first end portion disposed adjacent said opening;

a second end portion disposed adjacent said bottom wall; and an elongated main portion disposed between said first and second end portions and to extend along a substantial portion of the length of said container body.

3. The beverage can container according to claim 2, wherein said elongated main portion comprises a thin wall having a thickness being less than a thickness of said side wall to promote temporary deformation of said elongated main portion.

4. The beverage can container according to claim 3, wherein said elongated main portion comprises a resiliently elastic material.

5. The beverage can container according to claim 4, wherein:

said first end portion comprises a first wall portion configured and disposed to form a portion of said side wall of said container body;

said second end portion comprises a second wall portion configured and disposed to form a portion of said side wall of said container body;

said first wall portion having a thickness being less than the thickness of said side wall of said container body to form an air passage between said first wall portion and a beverage can inserted in said container body; and said air passage is configured and disposed to connect said air chamber to the air space under said container lid adjacent a lip portion of a beverage can inserted in said container body.

6. The beverage can container according to claim 4, wherein said projection is one of: integrally formed with said container body or attached to said container body.

7. The beverage can container according to claim 6, wherein:

said first end portion comprises a first projecting portion configured to project out and away from said first wall portion and having a greater thickness than said first wall portion;

said second end portion comprises a second projecting portion configured to project out and away from said first wall portion and having a greater thickness than said first wall portion; and said first and second projecting portions form end walls of said air chamber and said elongated main portion forms a side wall of said air chamber.

8. The beverage can container according to claim 7, wherein:

at least one of said two projecting portions comprises a notch or recess configured and disposed to divide its projecting portion into a reinforcing portion and a flexible portion integrally formed with said elongated main portion;

said flexible portion being of similar thickness as said elongated main portion to facilitate temporary deformation and displacement of said elongated main portion; and said reinforcing portion being of substantially greater thickness than said flexible portion to protect against damage or excessive deformation of said flexible portion.

9. The beverage can container according to claim 8, wherein:

said container lid comprises a sealing structure configured and disposed to project from an interior surface of said container lid; and said sealing structure is configured and disposed to project into and sealingly engage in an airtight manner a lip portion of said container body about said opening in said container body upon said container lid being closed.

10. The beverage can container according to claim 9, wherein said sealing structure comprises a rubber gasket being substantially cylindrical and having an outer surface configured to essentially match the interior shape of said container body at said container opening.

11. The beverage can container according to claim 10, wherein said sealing structure comprises an inner surface configured to essentially match or follow a lip portion of a beverage can to minimize the air space under the container lid.

12. The beverage can container according to claim 2, wherein:

said first end portion comprises a first wall portion configured and disposed to form a portion of said side wall of said container body;

said second end portion comprises a second wall portion configured and disposed to form a portion of said side wall of said container body;

said first wall portion having a thickness being less than the thickness of said side wall of said container body to form an air passage between said first wall portion and a beverage can inserted in said container body; and said air passage is configured and disposed to connect said air chamber to the air space under said container lid adjacent a lip portion of a beverage can inserted in said container body.

13. The beverage can container according to claim 12, wherein:

said first end portion comprises a first projecting portion configured to project out and away from said first wall portion and having a greater thickness than said first wall portion;

said second end portion comprises a second projecting portion configured to project out and away from said first wall portion and having a greater thickness than said first wall portion; and said first and second projecting portions form end walls of said air chamber and said elongated main portion forms a side wall of said air chamber.

14. The beverage can container according to claim 13, wherein:

at least one of said two projecting portions comprises a notch or recess configured and disposed to divide its projecting portion into a reinforcing portion and a flexible portion integrally formed with said elongated main portion;

said flexible portion being of similar thickness as said elongated main portion to facilitate temporary deformation and displacement of said elongated main portion; and said reinforcing portion being of substantially greater thickness than said flexible portion to protect against damage or excessive deformation of said flexible portion.

15. The beverage can container according to claim 1, wherein:

said container lid comprises a sealing structure configured and disposed to project from an interior surface of said container lid; and said sealing structure is configured and disposed to project into and sealingly engage in an airtight manner a lip portion of said container body about said opening in said container body upon said container lid being closed.

16. The beverage can container according to claim 15, wherein said sealing structure comprises a rubber gasket being substantially cylindrical and having an outer surface configured to essentially match the interior shape of said container body at said container opening.

17. The beverage can container according to claim 16, wherein said sealing structure comprises an inner surface configured to essentially match or follow a lip portion of a beverage can to minimize the air space under the container lid.

18. The beverage can container according to claim 1, wherein said projection is one of: integrally formed with said container body or attached to said container body.

19. A method of closing and opening a beverage can container according to claim 1, said method comprising the steps of:

inserting a beverage can through said opening and into said container body;

pivoting said container lid and closing and sealing said opening in an essentially airtight manner; and manually depressing said projection and displacing air in said chamber and thereby pushing said container lid open and out of sealing engagement with said container body.

20. The method according to claim 19, wherein said step of displacing air and opening said lid comprises:

displacing air out of said air chamber and into an air passage formed between an end portion of said projection at a top portion of the beverage can in said container body;

displacing air from said air passage into a space in said container body below said container lid and adjacent the top portion of the beverage can; and creating increased air pressure within the space sufficient to push said container lid open and out of sealing engagement with said container body.

* * * * *